US005269377A

United States Patent [19]

Martin

[11] Patent Number: 5,269,377

[45] Date of Patent: Dec. 14, 1993

[54] COIL TUBING SUPPORTED ELECTRICAL SUBMERSIBLE PUMP

[75] Inventor: Fred S. Martin, Claremore, Okla.

[73] Assignee: Baker Hughes Incorporated, Houston, Tex.

[21] Appl. No.: 981,705

[22] Filed: Nov. 25, 1992

[51] Int. Cl.[5] ..... E21B 23/00

[52] U.S. Cl. ..... 166/385; 166/65.1; 174/47

[58] Field of Search ..... 166/65.1, 68, 242, 105, 166/380, 385, 386; 138/111, 125, 137, 126; 174/47, 102 R, 103

[56] References Cited

U.S. PATENT DOCUMENTS

| | | | |
|---|---|---|---|
| 3,835,929 | 9/1974 | Suman, Jr. | 166/65.1 X |
| 4,336,415 | 6/1982 | Walling | 174/47 |
| 4,346,256 | 8/1982 | Hubbard et al. | 166/242 X |
| 4,681,169 | 7/1987 | Brookbank, III | 166/385 |
| 5,145,007 | 9/1992 | Dinkins | 166/65.1 X |
| 5,146,982 | 7/1992 | Dinkins | 166/65.1 |

OTHER PUBLICATIONS

XL Technology; Project: Coiled Tubing Deployed Submersible Pump, Jan. 3, 1992.

*Primary Examiner*—Thuy M. Bui

*Attorney, Agent, or Firm*—James E. Bradley

[57] ABSTRACT

An electrical submersible well pump assembly supported on a continuous length of coil tubing. An electrical cable extends through the coil tubing from the pump assembly to the surface for supplying electrical power to the pump assembly. The cable is of lesser diameter than the inner diameter of the tubing, resulting in an annulus. Standoff members locate in the annulus to centralize the cable. Standoff members frictionally engage the inner diameter of the tubing and the outer diameter of the cable to transfer weight of the cable to the coil tubing. Flow passages extend through the annulus surrounding the cable to enable lubricant and coolant fluid to be pumped from the surface to the pump assembly.

21 Claims, 2 Drawing Sheets

COIL TUBING SUPPORTED ELECTRICAL SUBMERSIBLE PUMP

BACKGROUND OF THE INVENTION

1. Field of the Invention

This invention relates in general to electrical submersible well pump assemblies, and in particular to an electrical submersible pump supported on coil tubing.

2. Description of the Prior Art

Electrical submersible pumps for oil wells include a centrifugal pump mounted to a downhole electrical motor. In a conventional installation, the upper end of the pump secures to a lower end of a string of production tubing. The production tubing comprises threaded sections of tubing secured together, each about 30 feet long. The motor usually locates below the pump. A power cable extends from the surface and straps to the exterior of the tubing. The tubing supports the weight of the pump assembly. The weight of the power cable is also supported by the tubing through the straps which secure the power cable to the tubing. The well fluid is produced through the tubing to the surface.

Periodically, the pump assembly must be pulled to the surface for replacement or maintenance. Also, the well may require maintenance. This requires a pulling unit which will unscrew and pull the sections of production tubing from the well. Pulling the pump and putting it back into the well on the sections of tubing can be time consuming. It also requires a unit which has a draw works for pulling the production tubing.

Proposals have been made in the past to eliminate the production tubing. Conventional electrical power cable cannot support the weight of the pump assembly, and in fact cannot even support its own weight in most wells. Consequently, a special power cable that would be weight supporting would be required. Although proposals has been made to utilize weight supporting cable, it is not common practice.

Also it has been proposed to support the electrical submersible pump assembly on coil tubing. Coil tubing is a continuous length of tubing that when pulled, will wind on a large reel located at the surface. The coil tubing is of smaller diameter than typical production tubing but it is of steel and will support weight. Although proposals have been made, there are no installations of electrical submersible pumps on coil tubing known to Applicant.

SUMMARY OF THE INVENTION

In this invention, the electrical submersible pump assembly is supported on coil or continuous tubing. The cable extends through the coil tubing for supplying electrical power to the pump assembly. The cable has an outer diameter that is less than the inner diameter of the tubing, resulting in an annulus surrounding the cable. Standoff means extends in this annulus for frictionally engaging the cable with the coil tubing to support the weight of the cable with the tubing.

Preferably, the annulus serves as a flow passage means for circulating fluid from the surface. Preferably the production from the pump flows around the exterior of the coil tubing to the surface. Cooling or lubricating fluid is circulated down the annulus surrounding the cable.

In one embodiment, the standoff members comprise elastomeric rings which encircle the cable and are spaced apart from each other along the length of the cable. The rings have flow passages extending through them for allowing fluid to be circulated through the annulus.

In another embodiment, the standoff means comprises a plurality of longitudinal elastomeric standoff members. These standoff members are strips extending longitudinally along the cable. Each strip is circumferentially spaced apart from the other strips to concentrically support the cable in the continuous tubing. Spaces between the strips define flow passages through the annulus.

In a third embodiment, the standoff members comprise longitudinally extending tubes. These tubes are also spaced circumferentially around the cable and extend continuously to the surface. The tubes frictionally engage the outer diameter of the cable and the inner diameter of the continuous tubing. The tubes serve as flow passages for circulating cooling or lubricant fluids to the pump.

In all three embodiments, preferably the elastomeric standoff members are of a material that expands when contacted by lubricating oil, a swelling agent, or heat. The expanding causes the standoff members to tightly grip the cable and the inner wall of the coil tubing.

DETAILED DESCRIPTION OF THE INVENTION

Figure 1:
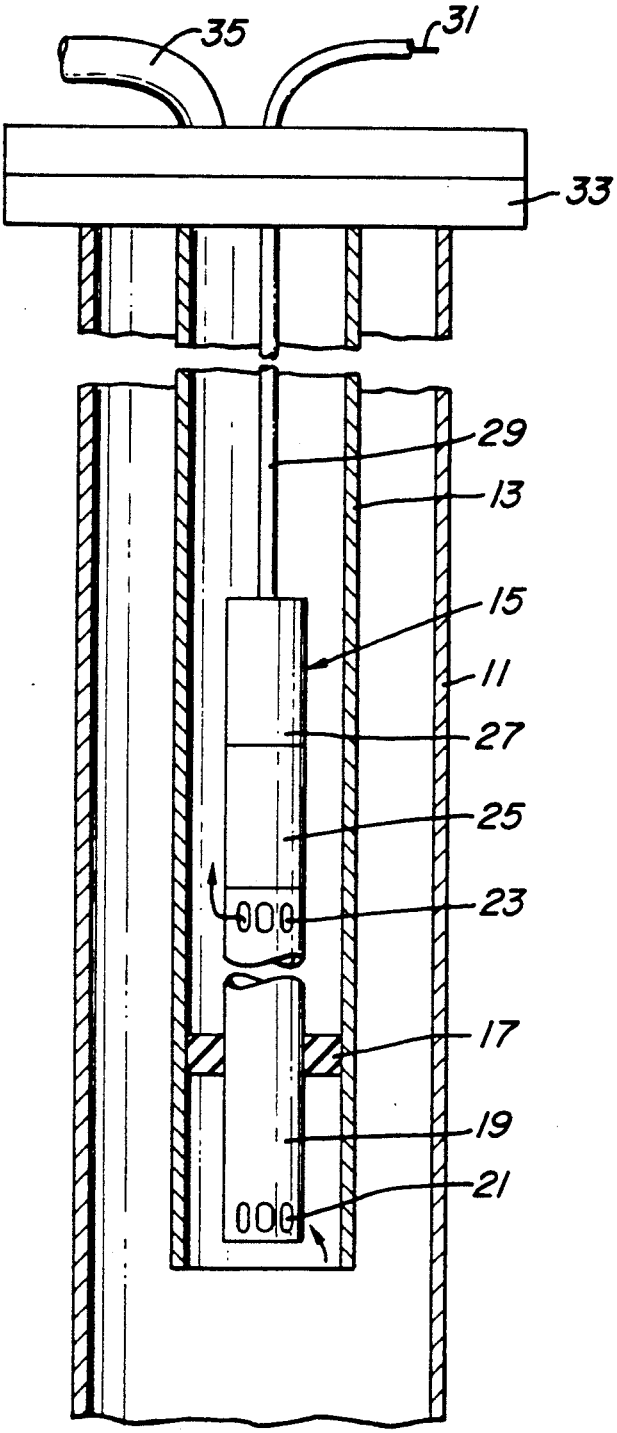
FIG. 1 is a schematic view illustrating an electrical submersible well pump installation constructed in accordance with this invention.

Referring to FIG. 1, the well includes casing 11 which will be cemented in place. In the embodiment shown, a tubular liner 13 extends through the casing 11. Liner 13, which serves as production tubing, is of a conventional type, having sections secured together by threads. A pump assembly 15 is supported inside the liner 13. A releasable packer 17 will support the pump assembly 15 in liner 13, and seal the annulus around pump assembly 15.

Pump assembly 15 includes a centrifugal pump 19 conventional design. Pump 19 has a lower end located below packer 17. Pump 19 has intake ports 21 below packer 17 and discharge ports 23 located above packer 17 for discharging well fluid pumped from the well. An electrical motor 25 rotates pump 19. Motor 25 is located above pump 19 and secures to an adapter 27. Adapter 27 may be of various types, and has means for securing to a lower end of a length of coil tubing 29.

Coil tubing 29 is metal, flexible tubing of a type that will coil onto a reel (not shown) located at the surface while coil tubing 29 is out of the well. This type of coil tubing 29 has been used for a variety of purposes.

Figure 2:
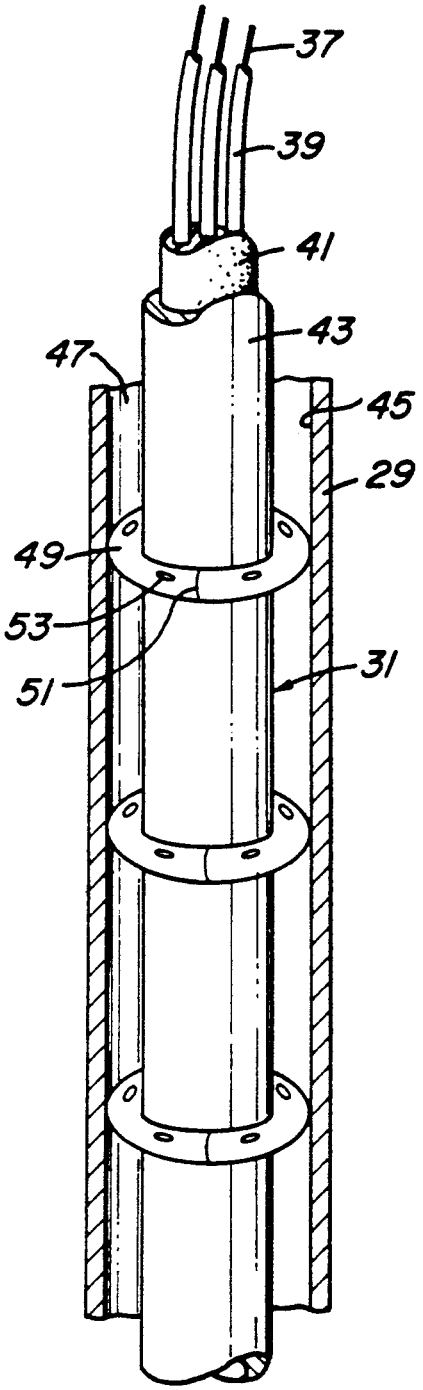
FIG. 2 is an enlarged perspective view illustrating a portion of the continuous tubing and electrical cable of the pump assembly of FIG. 1.

As shown also in FIG. 2, an electrical cable 31 extends through the coil tubing 29 from the pump assembly 15 to the surface. Electrical cable 31 supplies power to motor 25 and may be of conventional type. A tree 33 at the upper end of casing 11 provides pressure and valve control. A flow line 35 extends from tree 33 for delivering well fluids pumped by pump 19.

Referring to FIG. 2, electrical cable 31 is conventional, having three electrical conductors 37, one for each phase of the electrical motor 25. Electrical conductors 37 are encased in insulating layers 39. An elastomeric jacket 41 surrounds insulating layers 39, which will be generally spaced 180 degrees apart along the longitudinal axis of jacket 41. An outer elastomeric layer 43 surrounds jacket 41.

The transverse cross section of electrical cable 31 is cylindrical. The outer diameter of outer layer 43 is significantly less than the inner diameter 45 of coil tubing 29. This results in an annulus 47 surrounding electrical cable 31.

A standoff means is employed to support electrical cable 31 in coil tubing 29. In the embodiment of FIG. 2, the standoff means comprises a plurality of standoff rings 49. Standoff rings 49 are preferably elastomeric rings of a donut shape similar to an O-ring. However, the rings 49 could be a combination of other materials, such as a metal clamping ring with an elastomeric outer diameter or coating. Each standoff ring 49 is axially spaced apart from adjacent standoff rings 49, preferably by several inches. Each standoff ring 49 has an inner perimeter which will frictionally engage the outer diameter of electrical cable 31. The outer perimeter frictionally engages inner diameter 45 of coil tubing 29. The frictional contact is sufficient to transfer the weight of electrical cable 31 to the coil tubing 29. Standoff rings 49 are preferably of an elastomeric material which will swell or expand upon application of lubricating oil and heat from downhole well temperatures. Elastomeric materials which swell with heat and oil contact and which are suitable for use as a standoff ring 49 are known. U.S. Pat. No. 4,513,215, April 23, 1985. David I. Del Serra, describes a suitable material, all of which material is hereby incorporated by reference.

A split 51 in each standoff ring 49 enables the standoff ring 49 to be placed around electrical cable 31 during the manufacturing process. A plurality of flow passages 53 extend through each standoff ring 49 parallel to the longitudinal axis of coil tubing 29. Each flow passage 53 is preferably a small hole extending from an upper side to a lower side of each standoff ring 49, but could also be a channel along the outer diameter of each ring 49. Flow passages 53 are spaced circumferentially around the standoff rings 49. Flow passages 53 could allow fluid to be pumped down annulus 47 for lubricating or cooling of the pump assembly 15, for cooling of the motor 25, and for transfer of cable 31 heat to the coiled tubing 29. The fluid pumped down passages 53 could also cause swelling or expansion of the standoff rings 49.

Electrical cable 31 is installed in coil tubing 29 during manufacturing of coil tubing 29. Coil tubing 29 is preferably manufactured in a process in which a seam of the coil tubing will be welded as the tubing is formed from a strip into a cylindrical tube. The cable 31 will be positioned on the strip prior to the strip being folded into a cylindrical shape and the seam welded. The standoff rings 49 will be inserted around the electrical cable 31 by spreading apart the split 51. Then a section of the coil tubing 29 will be formed and welded along the seam. This process will be continued until the desired length of coil tubing 29 has been fabricated with electrical cable 31 inside. Then, the coil tubing 29 will be coiled on a reel (not shown) with the electrical cable 31 inside.

To install the pump assembly 15, the operator will connect the lower end of coil tubing 29 to adapter 27. The operator lowers the pump assembly 15 using the coil tubing reel. The pump assembly 15 will land in packer 17 in a conventional manner. The weight of the pump assembly 15 while being lowered into the well will be supported by the coil tubing 29. The weight of the electrical cable 31 will be supported by the coil tubing 29 through the frictional engagement of the standoff rings 49.

During operation, power will be supplied through conductors 37 to rotate motor 25, which in turn rotates pump 19. Well fluid will be drawn in from the well through ports 21 and pumped out ports 23 above packer 17. The well fluid flows up through liner 13 around the exterior of coil tubing 29.

At the same time, the operator may wish to supply a cooling fluid or lubricating fluid to pump assembly 15. The operator can handle this by pumping fluid from the surface down the annulus 47 and through the flow passages 53.

Figure 3:
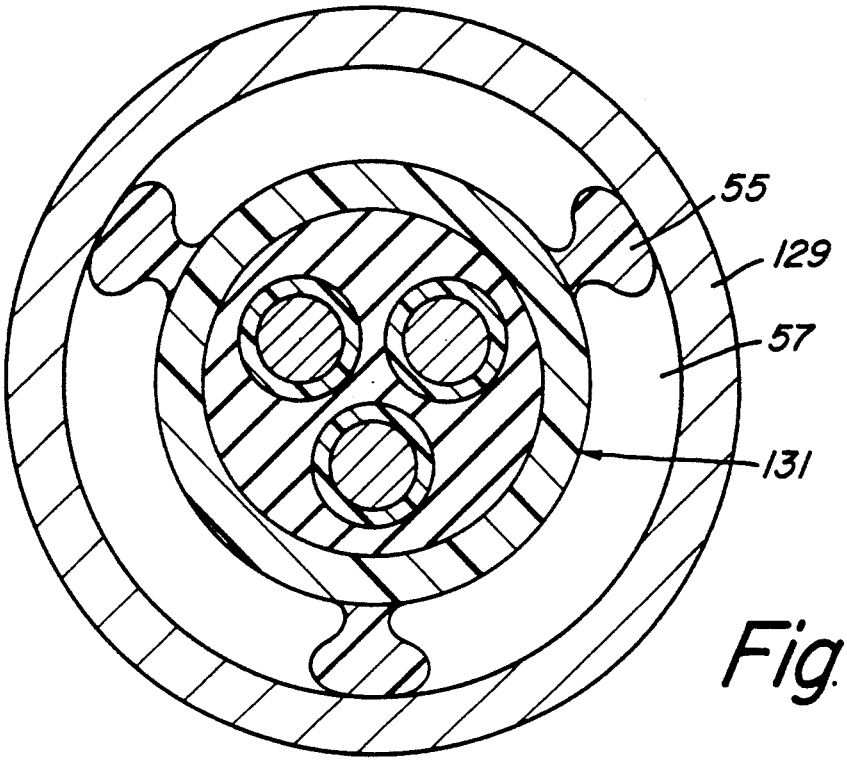
FIG. 3 is a transverse sectional view illustrating an alternate embodiment of standoff members for the electrical cable and continuous tubing of FIG. 1.

The cross sectional view of FIG. 3 represents an alternate embodiment, with common components to those in FIG. 1 being designated the same numeral with the addition of the prefix numeral "1". In this embodiment, longitudinal standoff members 55 are employed rather than annular standoff rings 49 (FIG. 2). Standoff members 55 are strips of an elastomeric material a few feet in length. The elastomeric material is also preferably of a type that swells with contact with oil and heat. Each standoff member 55 extends a few feet along the length of electrical cable 131. Axial spaces (not shown) may exist between upper and lower ends of standoff members 55 above and below each other.

Standoff members 55 are spaced circumferentially around electrical cable 131, with flow passages 57 located between. In the embodiment shown, three standoff members 55 are shown, each spaced 120 degrees apart from the other. Standoff members 55 frictionally grip both the outer diameter of electrical cable 131 and the inner diameter of coil tubing 129. After the assembly has been installed in the well, the operator can pump oil down the flow passages 57, which not only then provides cooling, but also causes swelling of the standoff members 55 to provide greater frictional retention.

Figure 4:
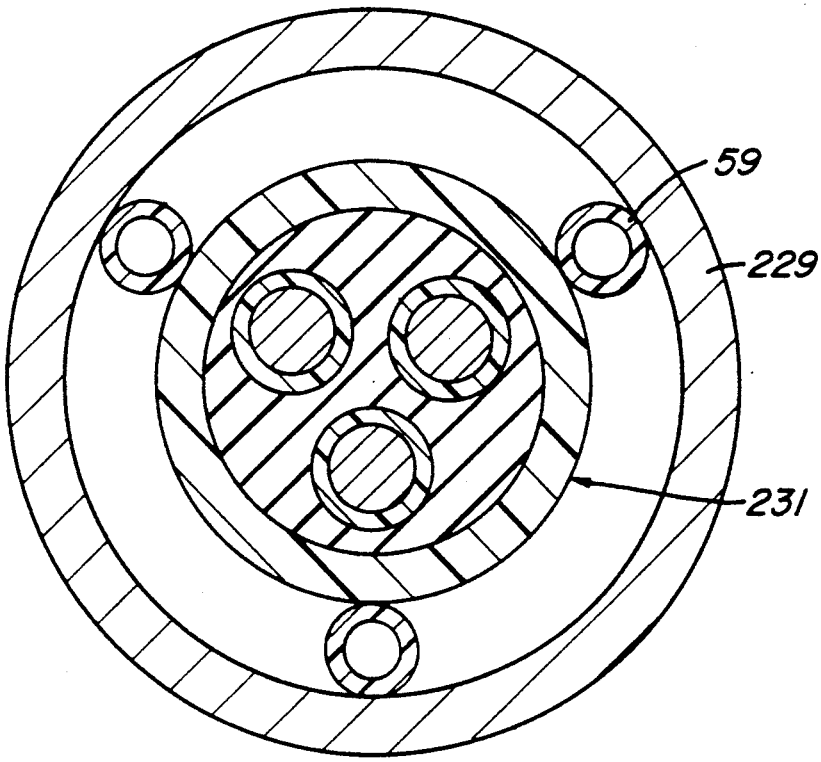
FIG. 4 is a transverse sectional view illustrating another alternate embodiment of standoff members for the cable and continuous tubing of FIG. 1.

In the embodiment of FIG. 4, common components to that of FIG. 1 will be indicated with the same numeral with the prefix "2". In this embodiment, the standoff members comprise tubes 59. Preferably, three tubes 59 are employed, each spaced 120 degrees apart from the other. Each tube 59 has a portion or side that frictionally engages the outer diameter of electrical cable 231 and an opposite side that frictionally engages the inner diameter of coil tubing 229. Cooling or lubricating fluids can be pumped down and circulated back up the tubes 59, or the fluid could be delivered to associated equipment, such as packers, or to the wellbore for chemical treatment. The frictional engagement of the tubes 59 supports the weight of the electrical cable 231. Tubes 59 extend continuously from the pumping assembly to the surface. Tubes 59 are also preferably of a material which swells upon application of heat and oil.

The invention has significant advantages. The standoff members will support the weight of the cable within the coil tubing. Making the outer diameter of the cable significantly less than the inner diameter of the coil tubing provides an annular space through which fluids can be circulated for cooling or lubricating.

While the invention has been shown in only three of its forms, it should be apparent to those skilled in the art that it is not so limited but is susceptible to various changes without departing from the scope of the invention.

I claim:

1. An apparatus for supporting an electrical submersible well pump assembly, comprising in combination:

a string of tubing extending from the surface and having a lower end connected to the pump assembly;

an electrical cable extending through the tubing from the surface to the pump assembly for supplying electrical power to the pump assembly;

the cable having an outer diameter and the tubing having an inner diameter that is greater than the outer diameter of the cable, defining an annulus surrounding the cable; and standoff means extending in the annulus extending between the outer diameter of the cable and the inner diameter of the tubing for transferring the weight of the cable to the tubing.

2. The apparatus according to claim wherein the standoff means comprises:

a plurality of elastomeric rings encircling the cable, having an inner perimeter engaging the cable and an outer perimeter engaging the inner diameter of the tubing, the rings being spaced apart from each other along the length of the tubing.

3. The apparatus according to claim wherein the standoff means comprises:

a plurality of elastomeric rings encircling the cable, having an inner perimeter engaging the cable and an outer perimeter engaging the inner diameter of the tubing, the rings being spaced apart from each other along the length of the tubing; and at least one passage extending through each of the rings from an upper side to a lower side of each of the rings, allowing fluid to flow through the annulus between the pump assembly and the surface.

4. The apparatus according to claim wherein the standoff means comprises:

a plurality of elastomeric rings encircling the cable, having an inner perimeter frictionally engaging the cable and an outer perimeter frictionally engaging the inner diameter of the tubing, the rings being spaced apart from each other along the length of the tubing, each of the rings being split to enable the rings to be placed on the cable.

5. The apparatus according to claim 1 further comprising passage means extending through the annulus for the passage of fluids between the surface and the pump.

6. The apparatus according to claim wherein the standoff means comprises:

a plurality of elastomeric standoff members spaced circumferentially apart from each other around the outer diameter of the cable and frictionally engaging the inner diameter of the tubing.

7. The apparatus according to claim wherein the standoff means comprises:

a plurality of tubes extending continuously through the length of the tubing from the surface to the pump for the passage of fluid between the surface and the pump assembly, the tubes being circumferentially spaced apart from each other around the outer diameter of the cable and frictionally engaging the inner diameter of the tubing and the outer diameter of the cable.

8. The apparatus according to claim 1 wherein the pump assembly pumps liquid from the well to the surface around the exterior of the tubing.

9. The apparatus according to claim wherein the standoff means comprises a plurality of standoff members, each of the standoff members being of an elastomeric material which swells upon application of oil.

10. An apparatus for supporting an electrical submersible well pump assembly, comprising in combination:

a continuous length of tubing having a longitudinal axis, the tubing extending from the surface;

means for connecting a lower end of the tubing to the pump assembly with a discharge of the pump assembly positioned to discharge well fluid on the exterior of the tubing to flow to the surface around the tubing;

an electrical cable extending through the tubing from the surface to the pump assembly for supplying electrical power to the pump assembly;

the cable having an outer diameter and the tubing having an inner diameter that is greater than the outer diameter of the cable, defining an annulus surrounding the cable; and a plurality of elastomeric rings in the annulus, each frictionally engaging the outer diameter of the cable and frictionally engaging the inner diameter of the tubing, for supporting the cable concentrically in the tubing and for supporting the weight of the cable with the tubing, the rings being axially spaced apart from each other along the length of the tubing.

11. The apparatus according to claim 10 wherein the rings are split to enable installation on the cable.

12. The apparatus according to claim 10, further comprising:

a plurality of passages extending axially through each of the rings and spaced circumferentially around each of the rings for allowing fluid to flow through the annulus from the surface to the pump assembly.

13. The apparatus according to claim 10 further comprising:

a plurality of passages extending axially in each of the rings and spaced circumferentially around each of the rings for allowing fluid to flow through the annulus between the surface and the pump assembly; and wherein the rings are split to enable installation on the cable.

14. An apparatus for supporting an electrical submersible well pump assembly, comprising in combination:

a continuous length of tubing extending from the surface;

mounting means for mounting the pump assembly to a lower end of the tubing with a discharge of the pump assembly positioned to discharge well fluid on the exterior of the tubing;

an electrical cable extending through the tubing from the surface to the pump assembly for supplying electrical power to the pump assembly;

the cable having an outer diameter and the tubing having an inner diameter that is greater than the outer diameter of the cable, defining an annulus surrounding the cable; and a plurality of standoff members in the annulus extending from the outer diameter of the cable and frictionally engaging the inner diameter of the tubing for supporting the cable in the tubing, the standoff members being circumferentially spaced apart from each other around the cable.

15. The apparatus according to claim 14 wherein flow passages are located in the annulus between each of the standoff members for allowing fluid to flow between the surface and the pump assembly.

16. The apparatus according to claim 14 wherein the standoff members are longitudinal strips that frictionally engage the outer diameter of the cable.

17. An apparatus for supporting an electrical submersible well pump assembly, comprising in combination:

a continuous length of tubing extending from the surface;

mounting means for mounting the pump assembly to a assembly positioned to discharge well fluid on the exterior of the tubing;

an electrical cable extending through the tubing from the surface to the pump assembly for supplying electrical power to the pump assembly;

the cable having an outer diameter and the tubing having an inner diameter that is greater than the outer diameter of the cable, defining an annulus surrounding the cable; and a plurality of tubes extending through the length of the tubing from the surface to the pump, the tubes being circumferentially spaced apart from each other around the outer diameter of the cable and frictionally engaging the outer diameter of the cable and the inner diameter of the tubing.

18. The apparatus according to claim 17 wherein the tubes serve as a conduit means for allowing fluid to be supplied from the surface through the tubes to the pumping assembly.

19. A method for pumping liquid from a well, comprising:

placing an electrical cable in a continuous length of tubing which has an inner diameter greater than an outer diameter of the electrical cable;

positioning standoff members around the cable, causing the standoff members to frictionally grip the inner diameter of the tubing;

connecting an electrical pump assembly to the cable and lowering the pump assembly on the tubing into the well while supporting the weight o the cable with the tubing through the frictional engagement of the standoff members with the tubing; and supplying electrical power to the pump assembly and pumping liquid from the well to the surface.

20. The method according to claim 19 further comprising:

providing flow passages between the cable and the tubing; and flowing fluid through the flow passages.

21. The method according to claim 19 further comprising:

providing flow passages between the cable and the tubing;

flowing fluid through the flow passages; and pumping the liquid from the well with the pumping assembly around the exterior of the tubing.

* * * * *